United States Patent [19]

Holzapfel

[11] Patent Number: 4,640,190

[45] Date of Patent: Feb. 3, 1987

[54] COAXIAL SHAFT CONNECTION FOR A PRINTING MACHINE CYLINDER

[75] Inventor: Klaus Holzapfel, Dischingen, Fed. Rep. of Germany

[73] Assignee: M.A.N.-Roland Druckmaschinen Aktiengesellschaft, Augsburg, Fed. Rep. of Germany

[21] Appl. No.: 768,044

[22] Filed: Aug. 22, 1985

[30] Foreign Application Priority Data

Aug. 26, 1984 [DE] Fed. Rep. of Germany ..... 3431149

[51] Int. Cl.[4] ..... B41F 31/26

[52] U.S. Cl. ..... 101/348; 101/375; 29/123; 29/525; 403/282

[58] Field of Search ..... 101/153, 174, 212, 216, 101/348, 375, 376, DIG. 14; 400/175; 29/110, 123, 129, 525; 242/68, 68.4, 68.5, 116, 117, 118, 118.6; 285/330, 382, 382.1, 382.2, 382.4, 382.5; 403/280, 282, 375, 381

[56] References Cited

U.S. PATENT DOCUMENTS

| | | | |
|---|---|---|---|
| 2,487,177 | 11/1949 | Pollock | 101/348 |
| 2,840,113 | 6/1958 | Simpson et al. | 285/382 |
| 2,918,867 | 12/1959 | Killary et al. | 29/129 |
| 3,225,614 | 12/1965 | Skinner et al. | 474/902 |
| 4,089,265 | 5/1978 | White et al. | 101/375 |
| 4,197,798 | 4/1980 | Bardin | 101/375 |
| 4,272,872 | 6/1981 | Hess et al. | 29/123 |
| 4,465,387 | 8/1984 | Seitz et al. | 400/175 |
| 4,543,704 | 10/1985 | Soussloff | 29/525 |

FOREIGN PATENT DOCUMENTS

| | | | |
|---|---|---|---|
| 53277 | 6/1982 | European Pat. Off. | 101/216 |

*Primary Examiner*—Charles A. Pearson
*Assistant Examiner*—David A. Wiecking
*Attorney, Agent, or Firm*—Frishauf, Holtz, Goodman & Woodward

[57] ABSTRACT

To provide for an easily replaceable attachment of a printing cylinder (11) on a shaft (12), the shaft is formed as a stub shaft with a flange (13) projecting therefrom, and a disk-shaped groove or recess or bore is formed in the end face (14) of the milling roller, into which the flange is fitted by an interference fit. In order to provide for ease of engagement of the interference fit, the flange and/or the end face of the roller is undercut by a groove spaced somewhat from the fitting engagement surfaces to form a resilient lip (16) which is subjected to the interference fit. The flange and the milling roller are connected by one or more clamping screws or bolts (18).

3 Claims, 2 Drawing Figures

COAXIAL SHAFT CONNECTION FOR A PRINTING MACHINE CYLINDER

The present invention relates to a coaxial shaft connection, and more particularly to a coaxial shaft connection for use with milling rollers of printing machines, e.g. axially oscillating rollers, used for example in the dampers and inkers of printing machines, for example rotary offset printing machines.

BACKGROUND

Various types of dampers and inkers are well known, which use milling cylinders, see, for example, "Einführung in den Offsetdruck" ("Introduction to Offset Printing") by Wolfgang Walenski, Eggen-Fachbuchreihe, page 176, with respect to a damper, and the textbook "Techniken, Systeme, Maschinen" ("Technology, Systems, Machinery") by Oscar Frey, Polygraph-Verlag, page 97, for a milling cylinder for an inker. Such milling cylinders or rollers are frequently used both in sheet as well as web rotary offset printing machines. Such milling cylinders or rollers are generally constructed in the form of a hollow cylinder which is retained on a through-shaft, journalled in the side walls of the printing machine.

The cylinder is adjusted for precise rotation about the central axis of the shaft by means of clamping elements located, generally, on one side of the milling cylinder. The other side of the milling cylinder was loosely placed on the shaft. Use of a through-shaft, extending between the side walls of the milling cylinder has been found to cause problems. Adjustment of the precisely circular rotation of the circumference of the milling cylinder about the axis of rotation of the shaft is comparatively time-consuming. Additionally, fitting the shaft through the milling cylinders causes difficulty since, even small contamination, for example due to an internal ridge or flashing, chips, and the like, may cause the shaft to bind on the cylinder. Malfunction can also arise due to unskilled handling; for example if the milling cylinder is improperly aligned, the bearing journal retaining the shaft in the side walls of the printing machine may be damaged. Exchange of milling cylinders—which are subject to wear in the printing machine—thus frequently leads to difficulties which, in extreme cases, may require destruction of the shaft, for example cutting the shaft in order to be able to remove the milling cylinder at all if it requires replacement.

THE INVENTION

It is an object to provide a shaft connection for precisely and easily coaxially attaching a cylinder or roller on a shaft, in which the cylinder or roller will always run precisely concentrically with the axis of rotation of the shaft, to provide for increased stiffness of the roller, and to permit easy assembly and installation, without the possibility of poor installation due to unskilled or careless work.

Briefly, an end face of the cylinder or roller is formed with a disk-shaped circular recess. The shaft is a stub shaft, terminating in a flange which fits into the recess with an interengaging interference fit. In order to insure interengagement, the area forming the interference fit is made resilient by undercutting either the flange or the end face of the roller, or both, adjacent the fit, so that the actual engagement will be by a projecting lip which will have the required resiliency. Thus, the resiliency of the material of the respective flange and/or the end face of the roller adjacent the fit will provide for precise engagement. The flange and roller can then be attached together by suitable attachment means, for example one or more bolts circumferentially located about the flange and engaging the flange and the cylinder or roller.

The system has the advantage that it can be easily mounted, and is essentially "fool-proof", providing at all times precise positioning of the cylinder or roller with respect to the flange, and hence precise concentricity of the cylinder or roller with the axis of rotation of the flange, since it is a simple matter when manufacturing the roller and/or the flange to provide for exactly concentric surfaces forming the interference fit.

DRAWINGS

FIG. 1 illustrates in fragmentary form a milling cylinder and shaft attachment in accordance with the prior art; and FIG. 2 is an axial schematic cross section illustrating the attachment arrangement in accordance with the present invention.

DETAILED DESCRIPTION

Figure 1:
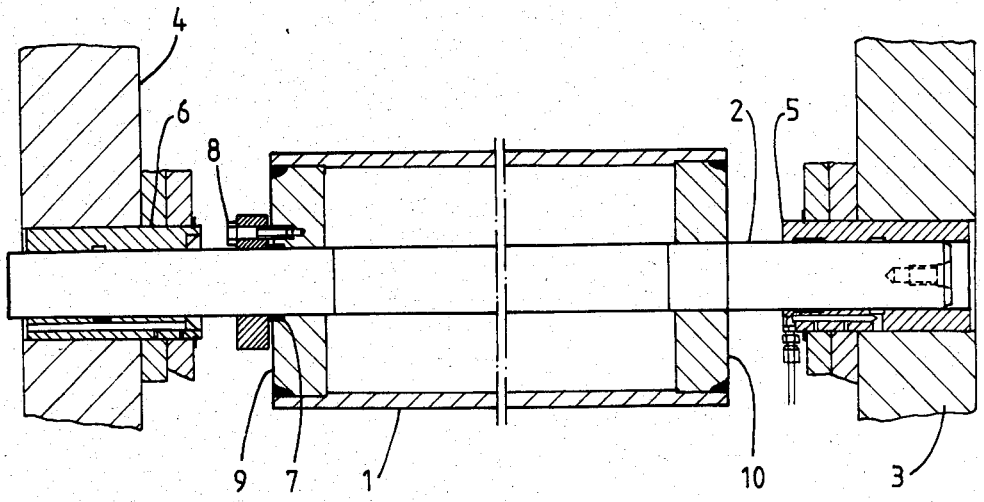
Fig. 1 PRIOR ART

The milling cylinder 1, FIG. 1, is installed, as is customary, in an inker or in a damper of a rotary printing machine, for example by being journalled between the side walls 3, 4 of the rotary printing machine. The other cylinders and other elements of the rotary printing machine are not shown, since they can all be of standard construction. In accordance with the prior art, it has been customary to utilize a through-shaft 2, the ends of which are inserted in journal bearings 5, 6, fitted into the side walls 3, 4 of the printing machine. The shaft 2 is clamped by means of a clamping element 7, only generally shown, and with a pressure flange and a plurality of screws 8 in one of the end faces 9, 10 of the cylinder 1.

Disadvantages of a through-shaft have been described in the background portion of the present specification.

Figure 2:
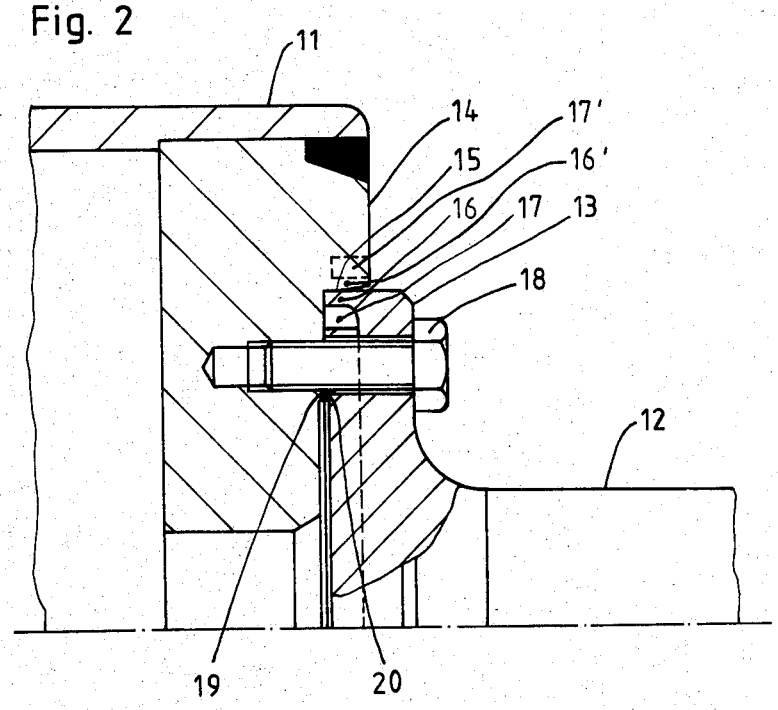

In accordance with the present invention, a milling cylinder 11, of which only the right side is shown in FIG. 2, is coupled to a shaft which is formed as a stub shaft 12, having an axis of rotation illustrated by the chain-dotted center line of FIG. 2. The stub shaft 12—and a similar stub shaft (not shown) which is located at the other, or left side of the cylinder 11 and for example the mirror image of the one to be described in detail, are journalled, as is customary, in the bearings 5, 6 in the side walls of the printing machine. The bearing arrangement of the stub shafts in the journals 5, 6 forms no part of the present invention and, therefore, can be conventional.

The stub shaft 12 has an integral or an attached flange 13. The cylinder 11 is secured to the end face 14 by means of the flange 13. The end face 14 of the side wall is formed with a concentric disk-shaped circular recess or bore 15. Flange 13 engages in the bore 15.

In accordance with the present invention, the region of the flange 13 which fits into the bore 15, to form an interengaging fit, forms an interference fit. To permit precise engagement, the region of the interference fit is formed with an elastic lip 16 which is generated by forming an undercut 17 in the flange 13, extending circumferentially, and spaced from the outer surface of the flange 13 by a suitable distance to permit the resulting lip 16 to be slightly resilient. The spacing is determined by the material used, and is a compromise between strength and resiliency; a few millimeters spacing is usually appropriate, the precise dimension being readily determinable upon knowing the materials used, torques, and operating conditions.

The thickness of the lip must be so dimensioned that, in spite of the interference fit, a slight resiliency remains between the flange 13 and the bore 15, so that, when the flange 13 is fitted into the bore 15, excessive engagement force is not necessary while, at the same time, ensuring exact, precise concentric positioning of the stub shaft 12 on the facing side 14 of the cylinder 11. The arrangement, thus, effectively prevents out-of-round errors and rotational running errors of the cylinder 11.

The lip can be formed, selectively, on the flange, as shown in full lines and/or on the end portion, that is, in the end face 14 of the cylinder 11. For example, both the end portion of the cylinder 11 as well as the flange 13 may be formed with respective undercuts 17, 17' to define the lips 16, 16'. Since formation of both lips is not usually necessary, the undercut 17' is shown in broken-line representation.

The flange 13 is, preferably, attached to the end portion including the face 14 of the milling roller 11 by one or more bolts 18; a plurality of uniformly circumferentially spaced bolts 18 is preferred. The bolts 18 are secured in tapped bores formed in the end face portions forming the end faces 19. Preferably, finished end surfaces 19, 20 on the end portion having the face 14 of the milling roller 11 and of the flange additionally insure precise right-angle placement of the stub 12 against the milling roller 11. The surface 19 is formed in the disk shaped recess 15, that is, the bottom of the bore 15 is finished to receive the surface 20 on the flange 13.

In one example, the diameter of the bore 15 was 110 mm, and the flange had a nominal outside diameter of 110 mm. An interference fit with $$H7\begin{pmatrix}+0.035\\+0\end{pmatrix} \text{ and } p7\begin{pmatrix}+0.072\\+0.037\end{pmatrix}$$

was successfully tested.

The connection is particularly suitable for a milling roller or cylinder for a printing machine, but may be used, of course, with rollers or cylinders in other fields of technology in which precise axially concentric rotation of a cylinder which is replaceable, with respect to an axis of rotation, is of importance.

I claim:

1. Coaxial shaft connection for attaching a cylinder (11) to a shaft (12) both of which have the same axis of rotation, in which the cylinder is formed with an end face (14) and the shaft (12) comprises a stub shaft having a flange (13) extending therefrom and facing said end face, wherein, in accordance with the invention, the end face (14) is formed with a disk-shaped circular recess (15);

the flange (13) is received, at least in part, in the recess by an interengaging fit;

said circular recess (15) is formed with a finished planar surface (19) perpendicular to the axis of rotation of said cylinder (11) and defining a bottom of said recess;

said flange (13) is formed with a matching engagement planar surface (20) perpendicular to the axis of rotation of said shaft (12), and fitting against said planar surface (19) of said recess, thereby assuring precise alignment of said cylinder (11) and shaft (12);

the flange (13) has an outer diameter dimensioned to be fitted into the disk-shaped recess by an interference fit;

and the interengaging fit includes a resilient circumferential engagement lip (16, 16') defined by a groove (17, 17') formed in at least one of:

said flange (13) and said end face (14) of the cylinder (11), said lip being concentric with the axis of rotation of the shaft, and located spaced from said interengaging fit by a distance sufficient to provide resiliency of the material of the lip of the respective flange, or end face of the cylinder adjacent said interengaging fit; and means (18) to attach the flange to said cylinder.

2. Shaft connection according to claim 1, wherein said surfaces (19, 20) are finished surfaces.

3. Shaft connection according to claim 1, wherein the attachment means connecting the flange and the cylinder or roller comprises at least one connecting bolt (18) connecting the flange and the cylinder by a screw connection.

* * * * *